United States Patent [19]

Czarnowski

[11] 4,054,315

[45] Oct. 18, 1977

[54] TABLE ASSEMBLY FOR A WHEELCHAIR

[76] Inventor: Anzelm A. Czarnowski, 12413 S. Moody Ave., Palos Heights, Ill. 60463

[21] Appl. No.: 677,918

[22] Filed: Apr. 19, 1976

[51] Int. Cl.[2] ..... A47C 7/70

[52] U.S. Cl. ..... 297/153; 108/32; 108/62; 248/455

[58] Field of Search ..... 297/153, 148, 174; 108/62, 63, 151, 152, 134, 112, 69, 32; 248/458, 455

[56] References Cited

U.S. PATENT DOCUMENTS

| | | | |
|---|---|---|---|
| 236,588 | 1/1881 | Hoffmeier | 108/63 X |
| 318,131 | 5/1885 | Paine | 297/153 |
| 382,687 | 5/1888 | Burlin | 297/153 |
| 2,028,128 | 1/1936 | Braasch | 297/150 |
| 2,568,970 | 9/1951 | Roesel | 108/134 |
| 3,097,884 | 7/1963 | Alford | 297/153 |
| 3,320,949 | 5/1967 | Hatfield | 297/153 X |
| 3,338,627 | 8/1967 | Frank | 297/153 |
| 3,475,052 | 10/1969 | Kaposi | 297/153 |

*Primary Examiner*—Roy D. Frazier
*Assistant Examiner*—Darrell Marquette
*Attorney, Agent, or Firm*—Dominik, Knechtel, Godula & Demeur

[57] ABSTRACT

A table assembly for mounting and demounting to frame members of a wheelchair, said assembly having a table member with open ended locking slots to engage tubular leg and frame members; and elongated braces on the underside of the table member which can be lowered to engage tubular horizontal frame members on the wheelchair. The table member is provided with mounting means and an easel assembly which can be pivoted to selectively fixed positions. The table member is also provided with three upright walls and openable and closable leaves so the working surface can be extended when open, and the assembly can be carried as a box when closed.

10 Claims, 8 Drawing Figures

18
30
32
33
34
19
20
7-7
6
22
16
21
25
27
26
23
10
41
42
43
40
45
46
60
61
62
63
64

TABLE ASSEMBLY FOR A WHEELCHAIR

This invention relates to a table assembly which can be mounted and demounted to commonly manufactured wheelchairs which have leg members and frame members, generally of tubular steel.

It is an object of the present invention to provide a table assembly which can be quickly mounted to a wheelchair, even by the user of the chair, without requiring complex or tedious mounting procedures through the use of fasteners or the like. It is a feature of this object to provide a versatile table assembly which can directly engage vertical tubular members commonly found on wheelchairs and which further has movable braces which can be lowered to frictionally seat horizontal tubular members commonly found on such wheelchairs. Such a table assembly can therefore be easily and quickly mounted with only a few manipulative steps.

In another aspect, the advantages are realized by providing a table assembly which can have an extended work surface, an enclosed work surface, and mounting means for quickly installing an easel member for artistic work.

Such objects and advantages are obtained, together with still other objects and advantages which will occur to practitioners, by the invention of the following disclosure which includes drawings wherein.

Figures 4, 5, 6, 7, 8:
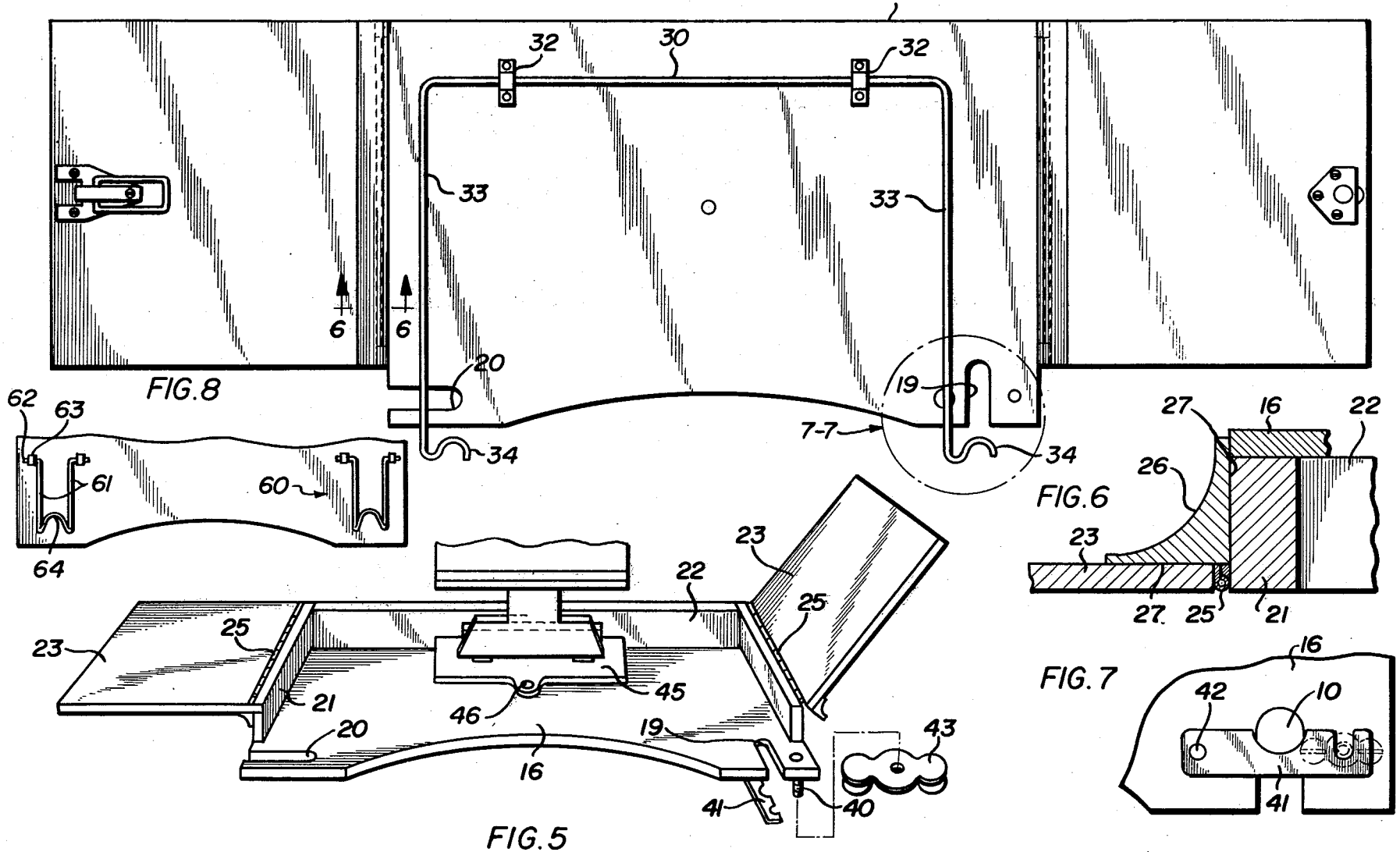
FIG. 4 is a bottom plan view, on an even larger scale, showing the leaves in open, extended position.
FIG. 5 is a perspective plan view similar to that of FIG. 2, but showing the leaves open and illustrating a clasp assembly with a nut fastener, of enlarged scale, for purposes of illustration.

FIG. 6 is a sectional view in portion, on an enlarged scale, taken along line 6—6 of FIG. 4; and FIG. 7 is a bottom plan view, on an enlarged scale, of the closed clasp assembly shown in the view of FIG. 5, and the area of location indicated by circular outline 7—7 in the view of FIG. 4; and FIG. 8 is a portional bottom plan view of an alternative brace embodiment for engaging an upper frame member of the wheelchair.

Figure 1:
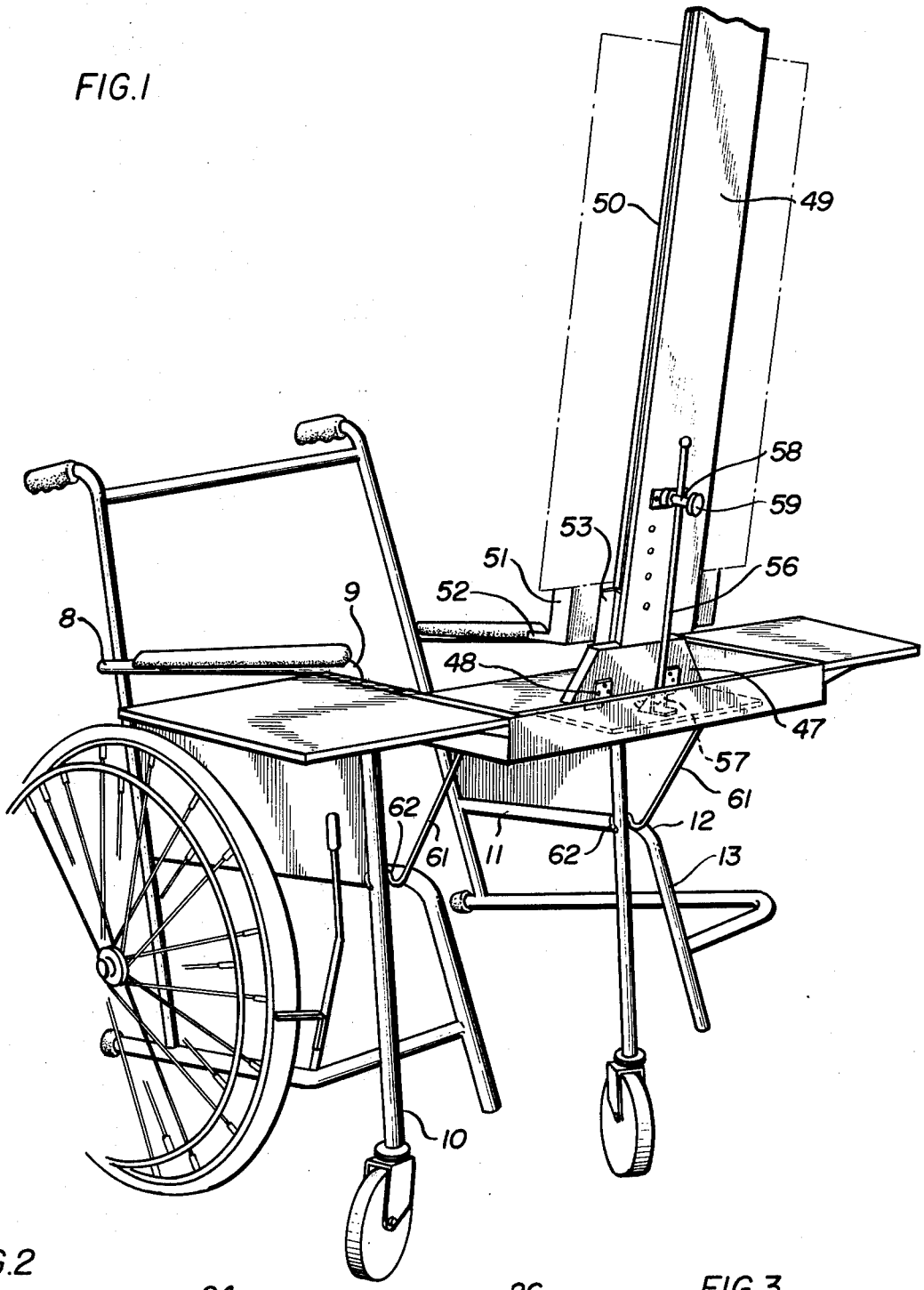
FIG. 1 is a perspective view showing a table assembly mounted to a wheelchair, with portions left out of the structures for purposes of clarity.

The view of FIG. 1 shows the table assembly with easel mounted to the wheelchair. The table assembly is provided with structures and elements for mounting to a conventional class of wheelchairs having vertical and horizontal members. A representative chair in this common class includes a horizontal arm rest member 8 which extends to a curved corner 9 which then joins a vertical forward leg member 10. Such chair is likewise shown to have a lower horizontal frame member 11 spaced below and substantially parallel to the arm rest member 8. The lower frame member 11 joins a curved corner 12 which is also joined to a slightly angled and downward frame member 13.

The table assembly is seen to include a planar table or tray member 16 defined, in part, by an irregular inner edge 17. A portion is shown as a recessed curvilinear edge 18 which begins and ends short of the opposite side edges of the planar table member 16. Such side edges are evident although not numbered, as is the front edge opposite to the inner or curvilinear edge 17. An outer edge 18 completes the periphery of the table, see FIG. 4.

A somewhat elongated locking slot 19 is shown adjacent one side edge, and said slot has its long axis normal to the inner edge 17. The locking slot is shown as having an open end which interrupts the inner edge and an opposite closed end. The slot extends a minor distance of the dimension between the inner edge and the opposite front edge. Another locking slot 20 is shown with its long axis parallel to the inner edge, and its open end interrupting the side edge. The locking slot 20 is dimensioned similarly to locking slot 19. Such slots receive portions of the vertical tubular leg members 10.

The planar member 16 is shown with a pair of spaced upright sides 21 and an upright front 22 (in FIG. 5). The upright sides and front are walls which forms a three sided enclosure for the planar member to retain any articles which may be placed on the table surface.

Figure 2:
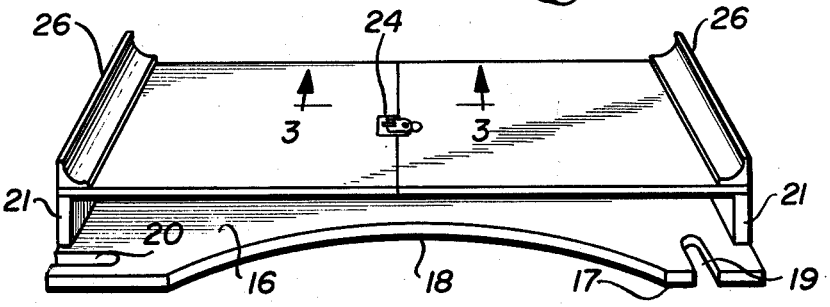
FIG. 2 is a perspective plan view of the table assembly in closed and operative position.
Figure 3:
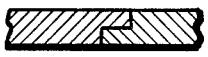
FIG. 3 is a portional, sectional view, on an enlarged scale, taken along line 3—3 of FIG. 2.

A leaf 23 is hingedly mounted at the top edge of each upright side 21. In closed position, the inner edges of the leaves form a rabbet joint as shown in the sectional view of FIG. 3, each inner edge having an upper or lower rabbet lap. A latch assembly 24 is positioned at the inner edges of the leaves to lock the leaves in closed position as shown in the view of FIG. 2. A piano hinge 25 is shown mounted to the outside of the upright sides and the outer edge of the leaves so that such leaves can be fully moved through 180° from a fully open position, as shown in FIG. 1, to a fully closed position, as shown in FIG. 2. An elongated angle 26 serves as a stop in fully open position, such angle having right angle faces 27, one of which is in flush abutment with upright sides 21, and the other being fixed by bonding or the like (not shown) to a face of the leaves. The table assembly is easily transported in closed position by utilizing an elongated handle opening 28 which is centrally located in the upright front 22.

The underside of the table assembly is shown with a unitary brace element for engaging frame members of the wheel chair. Such brace element has an elongated cross piece 30 which can be pivotably mounted in journals or collars 32. A pair of prebent arms 33 extend normally to the cross piece 60, and the ends of such arms 33 are modified into biased looped seats 34. The inverted J-shaped biased seats lie in a common plane which extends above the arms 33, and such planes intersect the long axes of such arms substantially at right angles. The arms 33 are pivoted downwardly, and the biased seats 34 then may engage the frame members, such as leg members 10 at junctions with frame members 11, see FIG. 1. The looped seats are widened when they engage the leg members, but are biased to resume original loop spacing, thereby providing a frictionally engaged seat.

The underside of the table member is shown with embedded bolt 40 extending downwardly at a corner area defined by an inner edge portion and the side edge. Such embedded bolt adjoins inner edge locking slot 19. The embedded bolt is used in cooperation with a scalloped edge clasp 41 which swings around pivot element 42. A plurality of scallops in the edge are dimensioned to respectively capture the tubular vertical leg member 10 and the embedded bolt 40, as shown in the view of FIG. 7. A wing nut 43 locks the clasp in its rotated capturing position.

The view of FIG. 5 shows a platform 45 removably secured to the planar table member by a fastener 46, which may be a winged nut. Such mounting means are provided to hold the easel assembly shown in the views of FIGS. 1 and 5. A general type of useful easel assembly is described in greater detail in copending application Ser. No. 267,487 by the same applicant, now allowed. Such an easel assembly has a base plate 47 which is pivotably mounted to the platform 46 by hinges 48. An elongated easel member 49 is fixed to the top of the base plate 47, and such easel is provided with opposite grooved edges 50. A block holder 51 supports an artist's workpiece, such as canvas or board. The block has an extending foot member 52 and a tongue plate 53 for engaging the grooved edges 50 to position the block and the supported workpiece.

Adjusting means are provided to fix the easel assembly in a selectively pivoted position. Such adjusting means is shown as including a rod 56 pivotally joined at its bottom to pivot plate 57, such pivot plate being mounted to one of the mounting bolts by removable fasteners in the same way as is base plate 47. The rod slidingly moves through an apertured slide element 58 fixed to the back of the easel member, the sliding passageway not being otherwise shown. A set screw 59 threadably engages the interior of slide element 58 to fix the rod in a selected position.

The braces of FIG. 8 are an alternative for the locking slots 19, 10. Each brace 60 is on the underside of the tray and adjacent inner edge 17. Each brace is a prebent rod having legs 61 with right angle ends 62 which pivot in journals 63. The legs are joined by a looped and biased seat 64 which is a reversely curved U-member. The seat 64 conforms to a cylindrical frame member and the sides of the loop are widened against normal biasing when engaging such a frame member. These braces are shorter than legs 33 and are designed to frictionally engage a junction of an arm rest and an upper horizontal frame member as is present in the JENNING's wheel chair.

in operation, side edge locking slot 20 is first engaged with one of the vertical frame members 10 by positioning the table angularly away from the wheelchair seat. Using the engaged slot 20 as a pivot, the table member is rotated towards the seat of the wheelchair so that inner edge locking slot 19 may then be engaged with the other vertical frame member 10. The elongated braces are then released and lowered until yielding seats engage the leg members 10 near the members 11. The clasp assembly is then closed to capture the vertical member 10 in slot 19. The vertical member now cannot be displaced because of the combination of the side edge locking slot 20 and the closed inner edge locking slot 19. The leaves are then opened to expose the working surface of the table member for use as a writing surface, a typewriter support, or the like. The easel member may be alternatively mounted in the manner described.

Alternatively, shorter braces 60 are pivoted downwardly so that biased seats 64 engage frame member junctions at a higher level than where biased seats 34 make their engagements. The lengths of legs 31 and braces 60 are so related to each other that the tray member is level when the braces are operatively engaged to the frame members.

The claims of the invention are now presented and the terms of such claims may be better understood by reference to the preceding specification and the views of the drawing.

What is claimed is:

1. A mountable and demountable table assembly for a wheelchair which has a pair of vertical leg members extending to arm rest members and horizontal frame members which are substantially parellel to said arm rests, including a planar table member having an inner edge, spaced side edges and an outer edge, leg braces pivotally mounted to the underside of the table member adjacent to the outer edge, said braces having looped and biased seats to engage frame member portions of the wheelchair, locking means associated with the table member adjacent the inner edge to engage frame members at a level higher than the frame portions engaged by the leg braces, said locking means including an inner edge locking slot having an open end located along said inner edge to engage a vertical leg member adjacent the arm rest member, and a side edge locking slot having an open end located along one of said side edge for engaging the other of said vertical leg members, mounting means positioned on said planar table member, and an easel assembly joined to said mounting means, said easel assembly including a pivotally mounted base member, an elongated easel member, and an elongated adjusting means to fix the elongated easel in a selectively pivoted position.

2. A mountable and demountable table assembly which includes the features of claim 1 above wherein said inner edge is modified by a recessed curvilinear edge portion between the side edges to accommodate the torso of a seated user.

3. A mountable and demountable table assembly which includes the features of claim 1 above wherein said table member includes, proximate to said inner edge locking slot, a clasp member pivoted to the underside and having a length to span said locking slot, a threaded bolt embedded in the underside of the table member on the side of the locking slot opposite to the side where the clasp is pivoted, seat configurations in an edge of said clasp member to capture the engaged vertical leg member and the threaded bolt, and a fastener to hold the clasp to the threaded bolt.

4. A mountable and demountable table assembly which includes the features of claim 1 above wherein said planar table member has upright sides along the side edges, an extension leaf hingedly mounted to the top of each upright side, and stop elements on the upright sides to support the leaves in extended level position, said leaves having relative dimensions so that when the leaves are pivoted towards each other they meet at a level edge to edge relationship parallel to and above said planar table member.

5. A mountable and demountable table assembly which includes the features of claim 4 above wherein an edge of each leaf opposite to the hinged edges forms an inner edge when such leaves are closed, each inner edge having a rabbet lap so that the closed leaves form a rabbet joint, and said stop means being elongated angles with one angle face flush against the upper and outer upright side, the other angle face being flush with the upper edge of the upright sides to support the extended leaves in raised and substantially parallel relationship to the table planar member.

6. A mountable and demountable table assembly which includes the features of claim 1 above wherein said mounting means is a platform releasably mounted on the planar table member.

7. A mountable and demountable table assembly which includes the features of claim 4 above and which further includes an upright front on the table member extending to the upright sides to thereby form a three sided enclosure for the table member.

8. A mountable and demountable table assembly which includes the features of claim 7 above wherein said leaves are hinged to said upright sides so that said leaves can be rotated 180° from full extended position to full closed position, said leaves supported in full closed position by the upper edges of the upright sides and front.

9. A mountable and demountable table assembly which includes the features of claim 1 wherein said leg braces are a pair of prebent arms joined in normal relationship to a crosspiece member pivotally mounted in a journal, and the ends of such arms are formed as looped yielding seats lying in a common plane which intersects the ends of said arms.

10. A mountable and demountable table assembly which includes the features of claim 11 wherein said locking means further includes a pair of pivotal braces adjacent said inner edge, said pivotal braces being shorter than said leg braces, the free ends of said braces having curved and biased loops to frictionally engage cylindrical frame members at a level higher than the frame members engaged by said leg braces, and the pair of braces having a length related to the length of the leg braces so that the table member is level when all the braces are operatively engaged with the frame members of the wheel chair.

* * * * *